US008777009B2

(12) United States Patent
Nakase

(10) Patent No.: US 8,777,009 B2
(45) Date of Patent: Jul. 15, 2014

(54) PACKING STRUCTURE FOR A THIN DISPLAY DEVICE

(71) Applicant: Panasonic Corporation, Osaka (JP)

(72) Inventor: Kiyotaka Nakase, Osaka (JP)

(73) Assignee: Panasonic Corporation, Osaka (JP)

( * ) Notice: Subject to any disclaimer, the term of this patent is extended or adjusted under 35 U.S.C. 154(b) by 0 days.

(21) Appl. No.: 13/900,017

(22) Filed: May 22, 2013

(65) Prior Publication Data

US 2013/0248401 A1 Sep. 26, 2013

Related U.S. Application Data

(63) Continuation of application No. PCT/JP2012/007279, filed on Nov. 13, 2012.

(30) Foreign Application Priority Data

Nov. 14, 2011 (JP) ..... 2011-248327

(51) Int. Cl.
*B65D 85/48* (2006.01)
*B65D 81/05* (2006.01)

(52) U.S. Cl.
USPC ..... 206/454; 206/523; 206/588; 206/592

(58) Field of Classification Search
USPC ..... 206/320, 449, 453, 454, 523, 588, 206/591–594; 211/41.1, 41.14
See application file for complete search history.

(56) References Cited

U.S. PATENT DOCUMENTS

| | | | | |
|---|---|---|---|---|
| 7,341,151 | B2 * | 3/2008 | Takagi | 206/454 |
| 7,588,148 | B2 * | 9/2009 | Yang | 206/523 |
| 8,082,858 | B2 * | 12/2011 | Yoshizawa | 108/53.1 |
| 2006/0226047 | A1 | 10/2006 | Takagi | |
| 2011/0308979 | A1 | 12/2011 | Mitsuhashi | |

FOREIGN PATENT DOCUMENTS

| | | |
|---|---|---|
| JP | 2006-232360 | 9/2006 |
| JP | 2006-290384 | 10/2006 |
| JP | 2008-18953 | 1/2008 |
| WO | 2010/116490 | 10/2010 |

OTHER PUBLICATIONS

International Search Report (ISR) issued Feb. 19, 2013 in International (PCT) Application No. PCT/JP2012/007279.

* cited by examiner

*Primary Examiner* — Bryon Gehman
(74) *Attorney, Agent, or Firm* — Wenderoth, Lind & Ponack, L.L.P.

(57) ABSTRACT

A packing structure for a liquid crystal display device includes a packing box for storing the liquid crystal display device and shock-absorbing members. The shock-absorbing members are stored in the packing box together with the liquid crystal display device so as to be interposed between the liquid crystal display device and the packing box. A side wall of a groove of the shock-absorbing member has a plurality of shock-absorbing surfaces with the gap with the display panel larger in the inside of the display panel than in the outside of the display panel. A central shock-absorbing member is disposed on the inside of the display panel deeper than the shock-absorbing face. The gap between the central shock-absorbing member and the display panel is larger than that between the shock-absorbing face and the display panel.

3 Claims, 4 Drawing Sheets

PACKING STRUCTURE FOR A THIN DISPLAY DEVICE

CROSS-REFERENCE TO RELATED APPLICATIONS

This is a continuation application of International Application No. PCT/JP2012/007279, with an international filing date of Nov. 13, 2012, which claims priority of Japanese Patent Application No.: 2011-248327 filed on Nov. 14, 2011, the content of which is incorporated herein by reference.

BACKGROUND

1. Technical Field

The present invention relates to a packing structure for a thin display device such as a liquid crystal display device and a plasma display device used as a television receiver, a monitor device or the like.

2. Description of Related Art

Needs for liquid crystal display devices has been growing for use as a professional as well as a residential flat-type video display unit.

Generally, the packing structure for thin display device includes a liquid crystal display device, a packing box to store the liquid crystal display device, and a shock-absorbing member disposed between the liquid crystal display device and the packing box. A liquid crystal display device usually includes a display module with a frame disposed on the front side of a flat-type liquid crystal display device and a backlight device as a surface light source disposed on the rear side of the flat-type liquid crystal display device. The display module is housed or stored in a thin housing including a front cabinet and a back cabinet (see JP 2006-232360 A). Packing structures for thin display devices other than the liquid crystal display devices (for example, plasma processing devices) have similar configuration as that of liquid crystal display devices

SUMMARY

The present invention provides a packing structure for thin display device which can effectively protect the thin display device against an external force such as a drop impact, vibration or the like suffered during transportation.

As for the recent thin display devices such as the liquid crystal display devices and the like, demands for thinner structures and narrower frames have been growing in view of improvement of design.

As the thin display devices become thinner and have narrower frames, the strength of the products decreases, which may cause deformation of display modules or cabinets, damages to the display panels, degrading of image quality as a result of drop impact, vibration or the like suffered during transportation of the packing.

Particularly, as the frames of the thin display is narrowed, dimensions of overlapping portions between peripheral areas of the display panel and the frame for holding the display panel tend to be reduced. Consequently, a phenomenon where the external force such as a drop impact, vibration or the like cause the display panels to be dropped off the device have become noticeable.

As described above, the external force such as a drop impact, vibration or the like suffered during transportation may cause deformation of display modules or cabinets, damages to the display panels, degrading of image quality or the like. Therefore, the present disclosure proposes a packing structure which can effectively protect a thin display device against an external force such as a drop impact, vibration or the like suffered during transportation.

The present disclosure provides a packing structure for thin display device comprising a packing case for storing a thin display device, and a shock-absorbing structure stored in the packing case together with the thin display device so as to be interposed between the thin display device and the packing case, the shock-absorbing structure being disposed so that a gap between the shock-absorbing structure and the display panel of the thin display device is larger in the inner side of the display panel than that in the outer side of the display panel. The shock-absorbing structure includes a first shock-absorbing member formed with a groove in which a peripheral portion of the thin display device is stored, the gap between a side wall of the groove and the display panel being larger in the inner side of the display panel than that in the outer side of the display panel, and a second shock-absorbing member disposed on inner side of the display panel than the first shock absorbing-member. The side wall of the groove formed in the first shock-absorbing member includes a plurality of shock-absorbing surfaces with different gaps with the display panel, the gaps between the shock-absorbing surfaces and the display panel becoming larger toward the inner side of the display panel. The gap between the second shock-absorbing member and the display panel is larger than that between the shock-absorbing surface disposed on the most inner side and the display panel.

The packing structure of the present disclosure can effectively protect a thin display device against an external force such as a drop impact, vibration or the like suffered during transportation and the like.

DETAILED DESCRIPTION

A packing structure for a liquid crystal display device according to an embodiment of the present disclosure will be described below with reference to the drawings by taking an example of a liquid crystal display device. However, unnecessarily detailed description may be omitted. For example, detailed description of already well-known matters and redundant description of substantially the same configuration may be omitted. All of such omissions are intended to facilitate understanding by those skilled in the art by preventing the following description from becoming unnecessarily redundant. The inventors provide the attached drawings and the following description for those skilled in the art to fully understand the present disclosure and do not intend to limit the subject described in the claims by the attached drawings and the following description.

Figure 1:
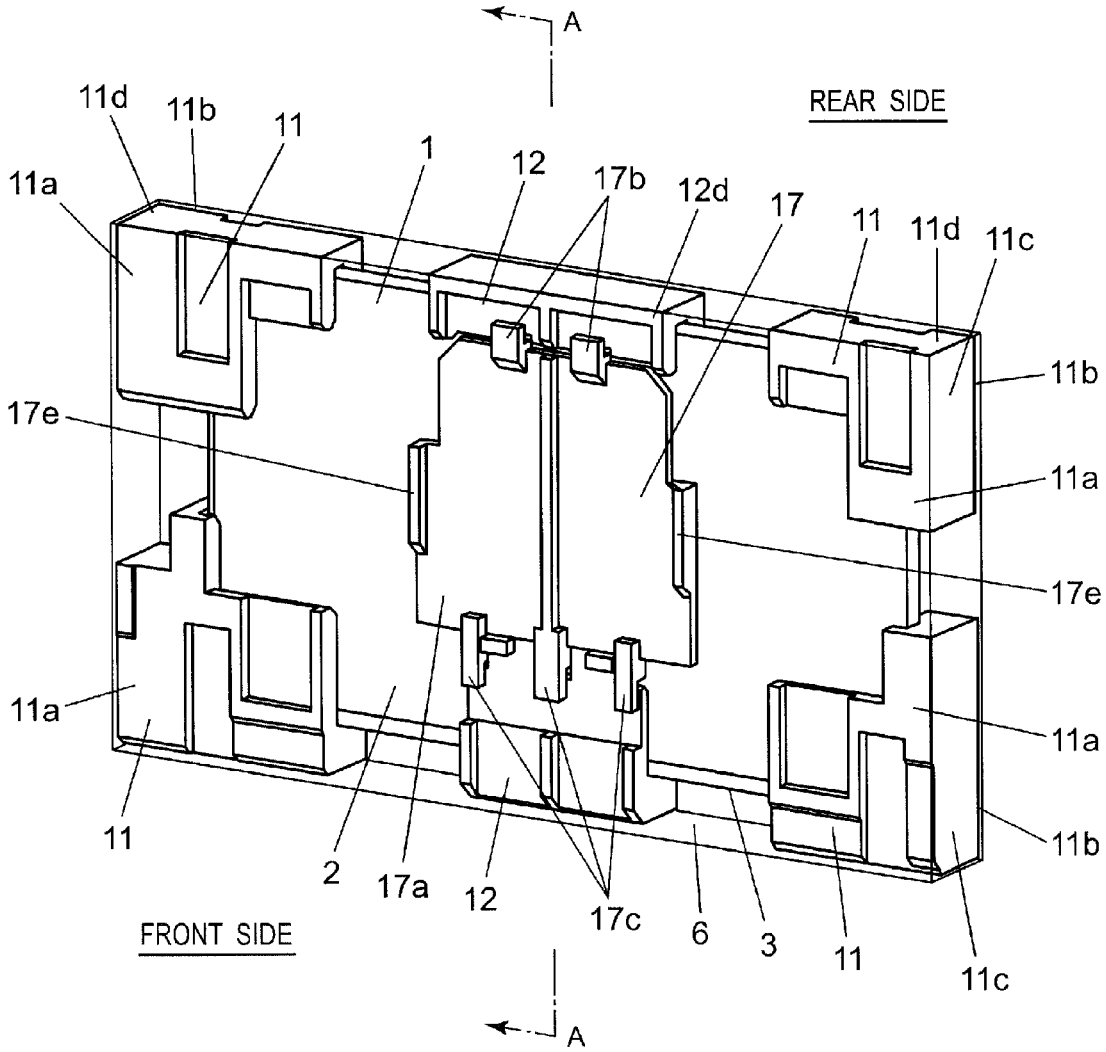
FIG. 1 is a general view showing a packing structure for liquid crystal display device according to an embodiment of the present disclosure.
Figure 2:
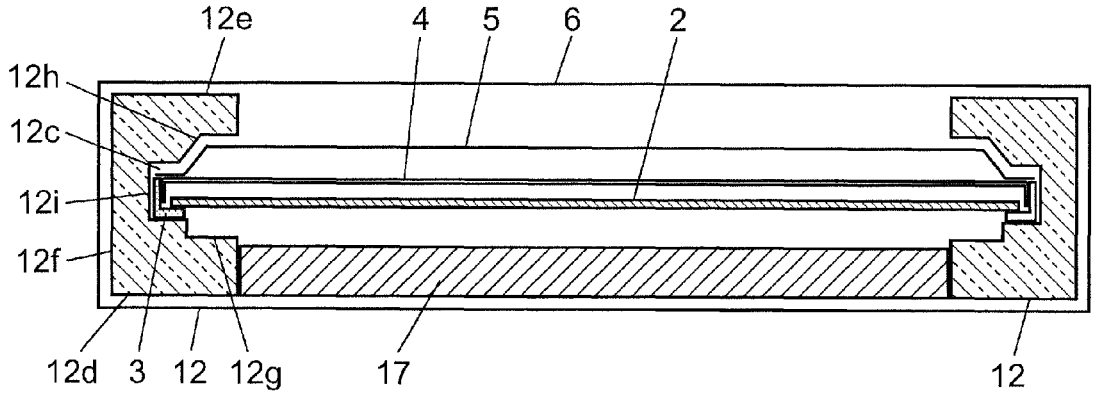
FIG. 2 is a sectional view taken along line A-A of FIG. 1.
Figure 3:
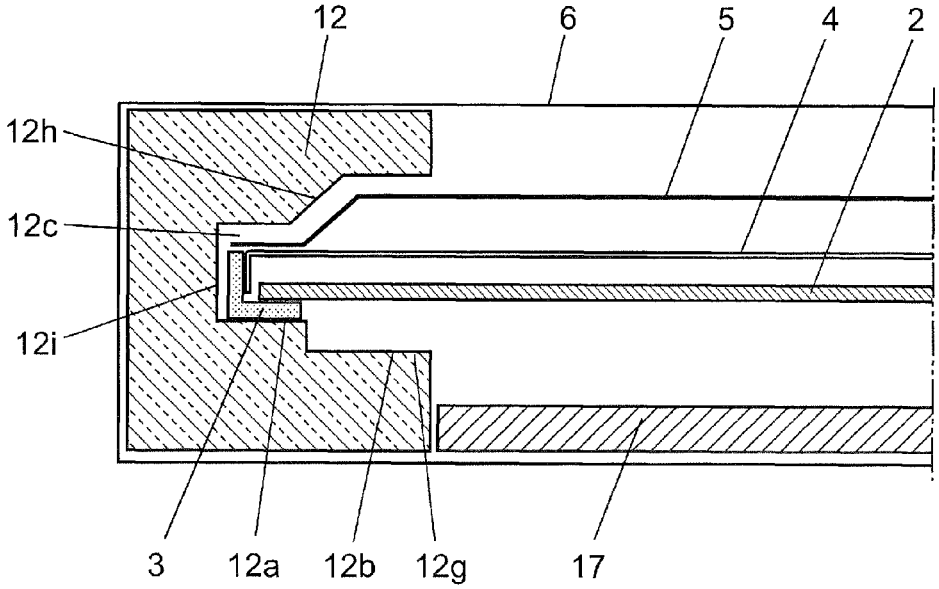
FIG. 3 is an enlarged view of the upper part of the sectional view taken along line A-A of FIG. 1.

FIG. 1 is a general view showing a packing structure for liquid crystal display device 1 according to the embodiment of the present disclosure. In FIG. 1, a near side corresponds to a front side of the liquid crystal display device 1. FIG. 2 is a sectional view taken along line A-A of FIG. 1. Further, FIG. 3 is a partial enlarged view of FIG. 2. In FIGS. 2 and 3, an upper portion corresponds to a rear side of the liquid crystal display device 1 and a lower portion corresponds to the front side of the liquid crystal display device 1. In these figures, a left hand side corresponds to an upper side of FIG. 1 and a right hand side corresponds to a lower part of FIG. 1

The packing structure of the liquid crystal display device 1 includes a packing box (packing case) 6 for the liquid crystal display device 1 and shock-absorbing members (shock-absorbing structures) 11, 12, 17 disposed in the packing box 6 together with the liquid crystal display device 1 so as to be interposed between the liquid crystal display device 1 and an inside of the packing box 6. The packing box 6 is made of material generally used as a packing material such as cardboard or corrugated paper. The shock-absorbing members 11, 12, 17 are made of materials having at least elasticity or shock-absorbing characteristics to some extent such as foaming polystyrene. In the present disclosure, an external shape of the liquid crystal display device 1 is generally a rectangular thin plate. The shock-absorbing members 11, 12, 17 are disposed such that a periphery of the liquid crystal display device 1 is sandwiched by corner shock-absorbing members 11 and the middle shock-absorbing members (first shock-absorbing member) 12 and such that a central shock-absorbing member (second shock-absorbing member) 17 is disposed between a central portion of the display panel 2 and the packing box 6.

As shown in FIG. 2, the liquid crystal display device 1 has a display module which includes a frame shaped front frame 3 disposed at the front side of the display panel 2, a rear frame 4 disposed at the rear side of the display panel 2, and a backlight device as a surface light source (not shown) disposed at the rear side of the display panel 2 within the front frame 3 and the rear frame 4. Further, a back cabinet 5 is disposed at the rear side of the display module.

At each of the four corner portions on the periphery of the liquid crystal display device 1, the corner shock-absorbing member 11 is disposed. As most clearly shown in FIG. 1, each of the four corner portions of the liquid crystal display device 1 is housed in the corner shock-absorbing member 11. A front surface 11*a*, a rear surface 11*b*, a side surface 11*c*, and an end face surface 11*d* of the corner shock-absorbing member 11 respectively abut with the inside of the packing box 6.

At each of the upper portion and the lower portion on the periphery of the liquid crystal display device 1, the middle shock-absorbing member 12 is disposed. The central portions in the width direction of the upper and lower portions of the liquid crystal display device 1 are respectively sandwiched by these two middle members 12. Specifically, the edges of the liquid crystal display device 1 are housed in the grooves 12*c* formed on the middle members 12. A front surface 12*d*, a rear surface 12*e*, and an end surface 12*f* of the middle shock-absorbing member 12 respectively abut with the inside of the packing box 6.

Further, the central shock-absorbing member 17 is disposed in the regions between the upper and lower side middle shock-absorbing members 12. The central shock-absorbing member 17 includes a body 17*a* as well as tab portions 17*b* and 17*c* protruded from upper and lower portions of the body 17*a*. The tab portions 17*b* and 17*c* are interposed between the middle shock-absorbing members 12 and the inside of the packing box 6. Further, a pair of rib portions 17*e* protruding toward the front side is provided on the both ends in the width direction of the body 17*a*. Distal ends of the rib portions 17*e* abut with the inside of the packing box 6.

The body 17*a* of the central shock-absorbing member 17 is opposite to the display panel 2 with a gap with the display panel 2. In the embodiment, slight gaps respectively are provided between the upper and lower side ends of the body 17*a* of the central shock-absorbing member 17 and the upper and lower side ends of the middle shock-absorbing member 12. In the embodiment, the width of the body 17*a* of the central shock-absorbing member 17 is set similar to that of the middle member 12. Therefore, the body 17*a* of the central shock-absorbing member 17 in the embodiment is interposed between the central portion of the display panel 2 and the inside of the packing box 6. However, the body 17*a* may be interposed between substantially the entire surface of the display panel 2 and the inside of the packing box 6.

As shown in FIG. 3, the groove 12*c* formed in the middle member 12 includes a first side wall 12*g* on the front side, a second side wall 12*h* on the rear side, and a bottom wall 12*i* connected with the base end of the first and the second side walls 12*g*, 12*h*. The second side wall 12*h* is formed in a shape which fits on the external contour of the back cabinet 5. In FIGS. 2 and 3, a gap is shown between the second side wall 12*h* and the rear (outside surface) of the back cabinet 5. However, the second side wall 12*h* may adjoin the rear of the back cabinet 5. The bottom wall 12*i* is formed in a shape which fits to an outer circumference surface of the front frame 3. In FIGS. 2 and 3, a gap is shown between the bottom wall 12*i* and the outer peripheral surface of the front frame 3. However, the bottom wall 12*i* may adjoin the outer peripheral surface of the front frame 3.

The first side wall 12*g* of the groove 12*c* of the middle member 12 includes a first shock-absorbing face 12*a* on the base end side (bottom wall 12*i*) and a second shock-absorbing face 12*b* closer to a distal side (opposite side of the bottom wall 12*i*) than the first shock-absorbing face 12*a*. In the embodiment, both of the first and the second shock-absorbing surfaces 12*a* and 12*b* are planes substantially parallel to the front of the display panel 2. The second shock-absorbing face 12*b* is placed in front side with respect to the first shock-absorbing face 12*a*. The first shock-absorbing face 12*a* functions as a face for receiving the front frame 3, while the second shock-absorbing face 12*b* functions as a face for receiving the display panel 2. Therefore, the boundary between the first shock-absorbing face 12*a* and the second shock-absorbing face 12*b* is set near to the inside area of the front frame 3 (near the edge of an opening for exposing the display panel 2).

As shown in FIG. 3, the second shock-absorbing face 12*b* is formed such that the gap between the second shock-absorbing face 12*b* and the display panel 2 is larger than the gap between the first shock-absorbing face 12*a* and the display panel 2. Further, the central shock-absorbing member 17 disposed in the inner side (at the center) of the display panel 12 with respect to the middle shock-absorbing member 12 is formed such that the gap between the central shock-absorbing member 17 and the display panel 2 is larger than the gap between the second shock-absorbing face 12*b* and the display panel 2. Thus, the gap between the second shock-absorbing face 12*b* placed in inner side (at the center) of the display panel 2 and the display panel 2 is larger than the gap between the first shock-absorbing face 12*a* placed in outer (peripheral) side of the display panel 2 and the display panel 2, and the gap between the central shock-absorbing member 17 placed in inner side (center) of the display panel 2 than the second shock-absorbing face 12*b* is larger than the gap between the second shock-absorbing face 12*b* and the display panel 2.

Figure 4A:
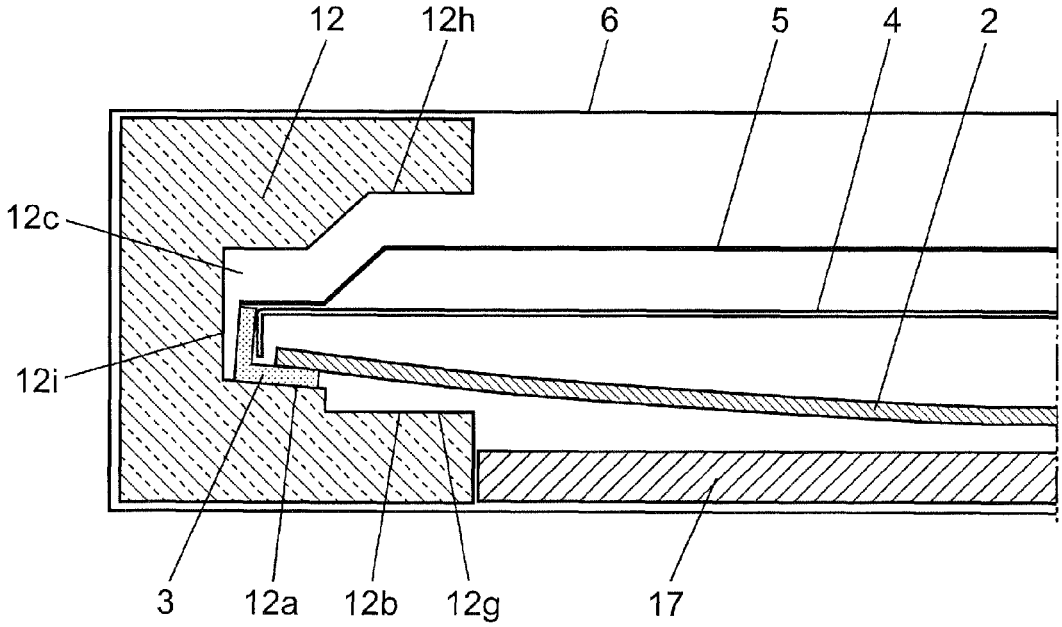
FIG. 4A is a sectional enlarged view showing a behavior of the packing structure for the liquid crystal display device according to the embodiment of the disclosure when the packing structure drops in a front direction (first step)
Figure 4B:
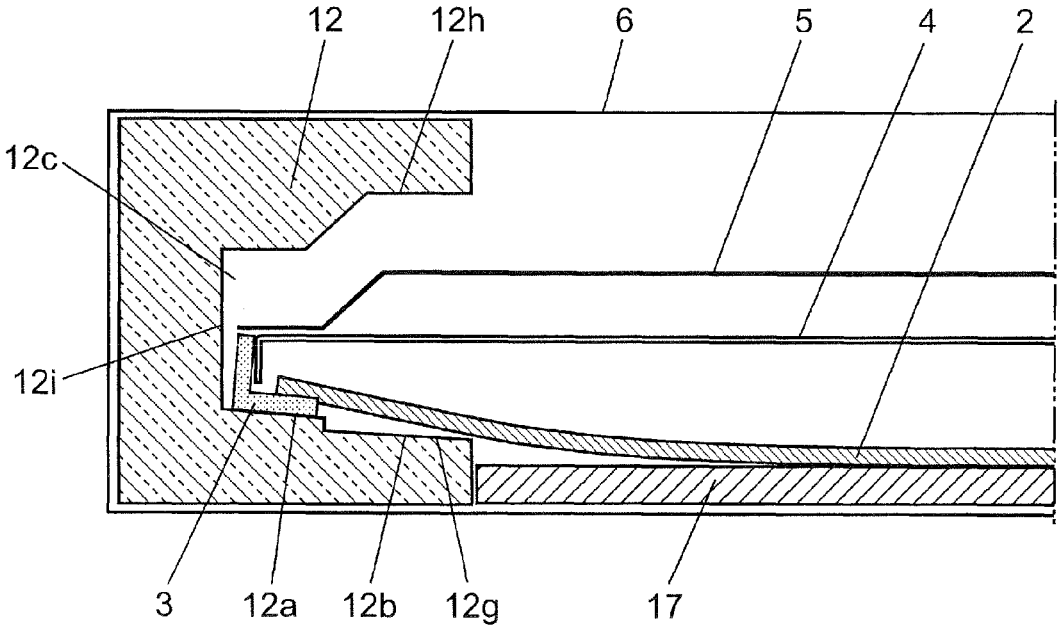
FIG. 4B is a sectional enlarged view showing a behavior of the packing structure for the liquid crystal display device according to the embodiment of the present disclosure when the packing structure drops in the front direction (second step)

FIGS. 4A and 4B are sectional enlarged views showing behaviors of the packing structure for the liquid crystal display device according to the embodiment of the present embodiment when it drops in the front direction (in the direction in which the display panel 2 faces downward). FIG. 4A shows a shock-absorbing state in a first step, and FIG. 4B shows a shock-absorbing state in a second step.

First, in the shock-absorbing state of the first step shown in FIG. 4A, the middle shock-absorbing member 12 is compressed at the first shock-absorbing face 12*a* when the middle shock-absorbing member 12 is pressed by the front frame 3, thereby the impact on the front frame 3 being reduced. Next, in the shock-absorbing state of the second step, the second shock-absorbing face 12*b* of the middle shock-absorbing member 12 and the central shock-absorbing member 17 suppress deformation of the display panel 2. Specifically, in the shock-absorbing state of the second step, a peripheral side of the display panel 2 contacts the second shock-absorbing face 12*b* of the middle shock-absorbing member 12, thereby the deformation of the display panel 2 being suppressed. Further, a portion of the display panel 2 closer to the center thereof than the second shock-absorbing face 12*b* of the middle shock-absorbing member 12 of the display panel 2 contacts the central shock-absorbing member 17, thereby the deformation of the display panel 2 is suppressed.

According to the present structure, since the impact is reduced to some extent in the shock-absorbing state of the first step, the pressure applied onto the display panel 2 due to the contact of the second shock-absorbing face 12*b* and the central shock-absorbing member 17 in the shock-absorbing state of the second step can be reduced. When the display panel 2 contacts the second shock-absorbing face 12*b*, the middle shock-absorbing member 12 is pushed by the display panel 2 so as to be elastically compressed. When the display panel 2 contacts the central shock-absorbing member 17, the central shock-absorbing member 17 is also elastically compressed. Accordingly, when contacting with the display panel 2, the second shock-absorbing face 12*b* and the central shock-absorbing member 17 exhibits elastic behavior instead of rigid behavior. This also can reduce the pressure onto the display panel 12.

Herein, it assumed that the middle shock-absorbing member 12 supports only the front frame 3 and the central shock-absorbing member 17 is not disposed. In that case, when the thin display device drops in the front direction during transportation, a phenomenon where the display panel 2 is dropped off the front frame 3 occurs, resulting in that the panel or degrading of image quality may easily occur.

As described above, according to the present embodiment, when an external force such as a drop impact, vibration or the like suffered during transportation acts on the liquid crystal display device 1, especially when the thin display device drops in the front direction, the front frame 3 firstly contacts the first shock-absorbing face 12*a* of the middle shock-absorbing member 12 to reduce the impact, and then the display panel 2 contacts the second shock-absorbing face 12*b* of the middle shock-absorbing member 12 and thereafter contacts the central shock-absorbing member 17. That is, the first shock-absorbing face 12*a*, the second shock-absorbing face 12*b*, and the central shock-absorbing member 17 constitute a step-wise shape in the cross-section in the direction where the groove 12*c* extends, and therefore the display panel 2 stepwisely contacts the shock-absorbing members. As a result, the deformation of the display panel 12 can be reduced, and therefore, the deformation of the display module or the back cabinet 5 (both of the back cabinet 5 and the front cabinet in the case where a front cabinet is present as described below) can be prevented and the damage to the display panel 2 and the degrading of image quality caused by the damage can be prevented while the pressure from the shock-absorbing members acting onto the display panel is being suppressed.

Figure 5:
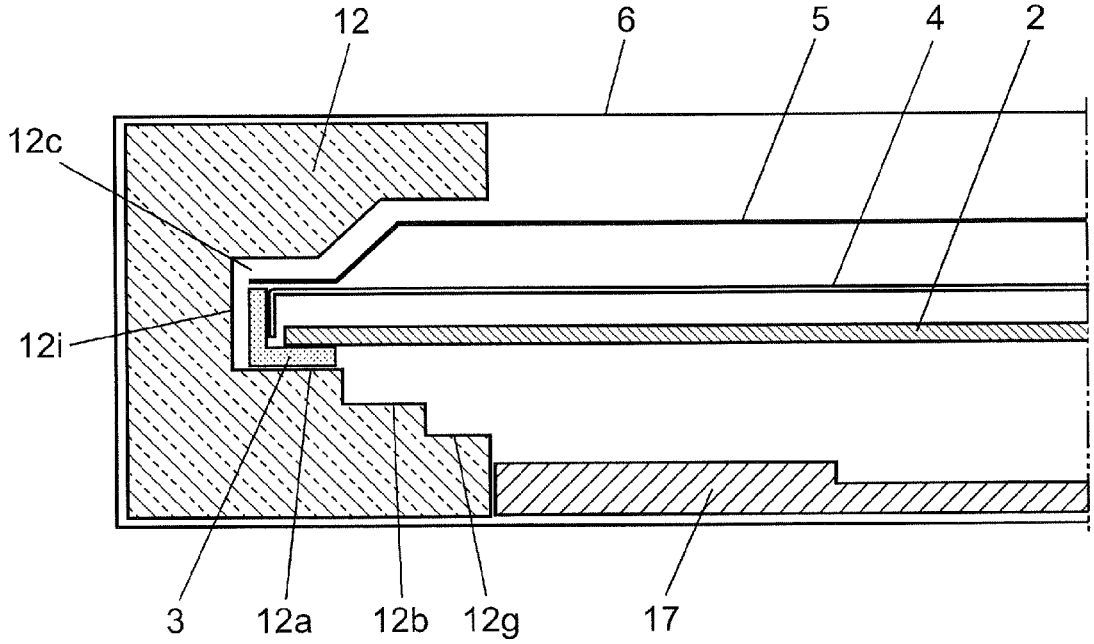
FIG. 5 is a sectional enlarged view showing another packing structure for the liquid crystal display device according to the embodiment of the present disclosure.

Although the first side wall 12*g* of the groove 12*c* formed in the middle shock-absorbing member 12 has two shock-absorbing surfaces in the present embodiment, two or more shock-absorbing surfaces may be formed as shown in FIG. 5. A plurality of shock-absorbing surfaces may be also provided on the central shock-absorbing member 17. In FIG. 5, in addition to the first and the second shock-absorbing surfaces 12*a*, 12*b*, a third shock-absorbing face 12*g* is further provided. The shock-absorbing faces are formed such that the gaps with the display panel 2 increase from the outer side (periphery) toward the inner side (center). Meanwhile, when the corners of the shock-absorbing face are round, the same effect can be achieved. Further, the shock-absorbing face is not necessarily a face parallel to the display panel 2, and may be a face tilting against the display panel 2 (face with a tapered cross section). Furthermore, in the case where the liquid crystal display device 1 has a structure of having the front cabinet disposed at the front side of the front frame 3, the same effect can be achieved.

The present disclosure can be applied to not only to packing for a liquid crystal display device but also to packing for another thin display devices such as a plasma display device.

Although the present disclosure has been fully described in connection with the preferred embodiments thereof with reference to the accompanying drawings, it is to be noted that various changes and modifications are apparent to those skilled in the art. Such changes and modifications are to be understood as included within the scope defined by the appended claims unless they depart therefrom.

What is claimed is:

1. A packing structure for a thin display device comprising:

a packing case for storing a thin display device; and a shock-absorbing structure to be stored in the packing case together with the thin display device so as to be interposed between the thin display device and the packing case, the shock-absorbing structure being configured so that a gap between the shock-absorbing structure and a display panel of the thin display device is larger at a center of the display panel than at a periphery of the display panel;

wherein the shock-absorbing structure includes:

a first shock-absorbing member having a groove in which a peripheral portion of the thin display device is to be stored, a first portion of the gap located between a side wall of the groove and the display panel being larger at a location closest to the center of the display panel than at a location at the periphery of the display panel; and a second shock-absorbing member to be disposed closer to the center of the display panel than the first shock absorbing-member;

wherein the side wall of the groove formed in the first shock-absorbing member includes a plurality of shock-absorbing surfaces such that the first portion of the gap located between the side wall of the groove and the display panel has different sizes in different locations along the side wall, a size of the first portion of the gap located between the shock-absorbing surfaces and the display panel becomes larger toward the center of the display panel; and wherein a second portion of the gap between the second shock-absorbing member and the display panel is larger than the first portion of the gap between the shock-absorbing surface at a location closest to the center of the display panel and the display panel.

2. The packing structure for a thin display device according to claim 1, wherein a cross-sectional shape of the side wall of the first shock-absorbing member has a step-wise shape constituted by the plurality of shock-absorbing surfaces.

3. A packing structure for a thin display device comprising:

a packing case for storing a thin display device; and a shock-absorbing structure to be stored in the packing case together with the thin display device so as to be interposed between the thin display device and the packing case;

wherein the shock-absorbing structure includes:

a first shock-absorbing member having a groove in which a peripheral portion of the thin display device is stored; and a second shock-absorbing member located closer to a center of the display panel than the first shock absorbing-member;

wherein a side wall of the groove formed in the first shock-absorbing member includes a shock-absorbing surface so that a first gap is formed between the shock-absorbing surface and a display panel of the thin display device; and wherein a second gap is formed between the second shock-absorbing member and the display panel, the second gap being larger than the first gap.

* * * * *